US005243937A

United States Patent [19]

Imagawa

[11] Patent Number: 5,243,937

[45] Date of Patent: Sep. 14, 1993

[54] PORTABLE ENGINE UNIT

[75] Inventor: Youichi Imagawa, Tokyo, Japan

[73] Assignee: Ryobi Limited, Tokyo, Japan

[21] Appl. No.: 814,142

[22] Filed: Dec. 27, 1991

[30] Foreign Application Priority Data

Dec. 29, 1990 [JP] Japan ..... 2-405793[U]

[51] Int. Cl.[5] ..... F02F 77/00

[52] U.S. Cl. ..... 123/195 R; 123/41.86

[58] Field of Search ..... 123/41.63, 41.65, 41.7, 123/41.86, 195 R, 195 C, 196 R, 196 CP, DIG. 5

[56] References Cited

U.S. PATENT DOCUMENTS 2,559,079 7/1951 Leja ..... 123/195 R 2,818,052 12/1957 Trainer, Jr. ..... 123/41.86

*Primary Examiner*—Noah P. Kamen

*Attorney, Agent, or Firm*—Brooks & Kushman

[57] ABSTRACT

A four-stroke cycle engine particularly for a working machine including a crank chamber structure comprises a crank chamber body defining a crank chamber in which a lubrication oil is sealed and in which a crank shaft mounting a counter-weight member thereon is rotatably supported, a rib member provided for the crank chamber body projecting in the crank chamber near the counter-weight member and a cover member for covering the crank chamber body. The cover member is provided with a projecting portion substantially facing a side surface of the counter-weight member and projecting deeply inside the crank chamber. The cover member comprises a main cover body secured to the crank chamber body, a side wall portion having a rotation surface of substantially a fallen trapezoidal shape in section, and a circular wall portion formed integrally with the side wall portion, the side wall portion and the circular wall portion constituting the projecting portion projecting inside the crank chamber as an integrated structure. The projecting portion is disposed substantially concentrically with a rotation axis of the crank shaft.

13 Claims, 5 Drawing Sheets

PORTABLE ENGINE UNIT

BACKGROUND OF THE INVENTION

This invention relates to a four-stroke cycle engine unit for a portable working machine and more particularly to a crank chamber of an improved structure of a four-stroke cycle engine unit provided with a cantilevered crank shaft.

Usually, a portable working machine such as a trimmer or lawn mower is equipped with an internal engine unit which is not always constant in its posture in the driving state, and it is often driven with an inclination of 40° to 50° in back and forth or lateral direction. Moreover, since such a working machine is usually handled by holding the same by hands of an operator, so that it is required for the engine unit to have a light weight and operate at high revolution speed. In order to satisfy such requirements, it may be desired to incorporate a two-stroke cycle engine to the portable working machine rather than a four-stroke cycle engine.

However, the four-stroke cycle engine provides the following advantages in comparison with the two-stroke cycle engine. That is, the four-stroke cycle engine generates relatively low noises, exhausts relatively clean exhaust gas, and relatively less amount of fuel is consumed in comparison with the two-stroke cycle engine. In consideration of these advantageous points, there has a tendency to incorporate the four-stroke cycle engine to a portable working machine in actual use.

However, when the four-stroke cycle engine is utilized in such inclined state or posture, lubrication oil fed into a crank chamber of the engine unit is excessively agitated by a counter-weight member provided for the crank shaft, which will result in adverse heat generation and causes or undesired resistance, oil-up state, etc.

Furthermore, during the engine operation in the inclined state, there is a problem that a magnitude of a pulsation pressure of a gas, almost air, in the crank chamber is insufficient for driving a fuel pump in association with a carburetor, i.e. membrane valve type carburetor. Namely, in the case of the four-stroke cycle engine unit, since a crank shaft, a cam shaft, a lubrication oil reservoir and the like are accommodated in the crank chamber, the space volume in the crank chamber is made large in comparison with the two-stroke cycle engine unit. Accordingly, a pulsation pressure of the gas having sufficient magnitude cannot be obtained by the reciprocal motion of a piston of a piston-cylinder assembly of the engine unit, thus being not suitable for the operation of the membrane valve type carburetor.

SUMMARY OF THE INVENTION

An object of this invention is to substantially eliminate defects or drawbacks encountered in the prior art and to provide a crank chamber structure of a four-stroke cycle engine unit particularly for a portable working machine having an improved inner arrangement capable of driving the four-stroke cycle engine unit effectively even in an inclined state in operation.

Another object of this invention is to provide a four-stroke cycle engine unit particularly for a portable working machine provided with an improved structure of the crank chamber.

These and other object can be achieved according to this invention by providing a crank chamber structure of a four-stroke cycle engine unit comprising:

a crank chamber body defining a crank chamber in which a lubrication oil is sealed and in which a crank shaft mounting a counter-weight member thereon is rotatably supported;

a rib member provided for the crank chamber body projecting in the crank chamber near the counter-weight member; and a cover member for covering the crank chamber body, the cover member being provided with a projecting portion substantially facing a side surface of the counter-weight member and projecting deeply inside the crank chamber.

In a preferred embodiment, the cover member comprises a main cover body secured to the crank chamber body, a side wall portion having a rotation surface of an inverted or fallen trapezoidal shape in section, and a circular wall portion formed integrally with the side wall portion, the wall portion and the circular wall portion constituting the projecting portion projecting inside the crank chamber as an integrated structure. The projecting portion is disposed substantially concentrically with a rotation axis of the crank shaft.

In another aspect of this invention, there is provided a four-stroke cycle engine unit comprising:

a crank chamber body defining a crank chamber in which a lubrication oil is sealed;

a crank shaft cantilevered to the crank chamber body so as to extend inside the crank chamber and rotatably supported therein;

a piston-cylinder assembly composed of a cylinder and a piston to be reciprocal in the cylinder;

a cylinder head disposed above the piston-cylinder assembly in which air intake and exhaust valves are accommodated;

a counter-weight member mounted to the crank shaft;

a connection rod having one end connected to the piston and another end connected to the counter-weight member through a crank pin;

a carburetor operatively connected to the cylinder head;

a rib member provided for the crank chamber body projecting in the crank chamber near the counter-weight member;

a cover member for covering the crank chamber body, the cover member being provided with a projecting portion substantially facing a side surface of the counter-weight member and projecting deeply inside the crank chamber.

According to the four-stroke cycle engine unit provided with the crank chamber of the improved structure according to this invention, the inner volume of the crank chamber can be effectively reduced, thereby causing a pulsation gas pressure larger than that of the conventional crank chamber structure, whereby the carburetor, i.e. membrane valve type carburetor of the four-stroke cycle engine unit can be operated even in its inclined state. The lubrication oil in the crank chamber is not excessively agitated even if the engine unit is driven in the inclined state, thus preventing adverse heat generation, resistance and oil-up phenomenon, and the oil is not also excessively lubricated to the piston of the piston-cylinder assembly of the engine unit.

The cover member for covering the crank chamber body has a projected wall portion projecting into the crank chamber, which fascilitates the advantageous effect described above.

Consequently, according to this invention, four-stroke cycle engine unit which can be effectively used even in the inclined state can be realized for a portable working machine.

BRIEF DESCRIPTION OF THE DRAWINGS

In the accompanying drawings:

FIGS. 1 to 3 are views representing one embodiment according to this invention, in which FIG. 1 is a perspective view of a portable working machine of a lawn mower in a used state provided with a four-stroke cycle engine unit, FIG. 2 is an elevational section of the engine unit of the working machine of FIG. 1 and FIG. 3 is a sectional view taken along the line III—III of FIG. 2;

DESCRIPTION OF THE PREFERRED EMBODIMENTS

Figure 4:
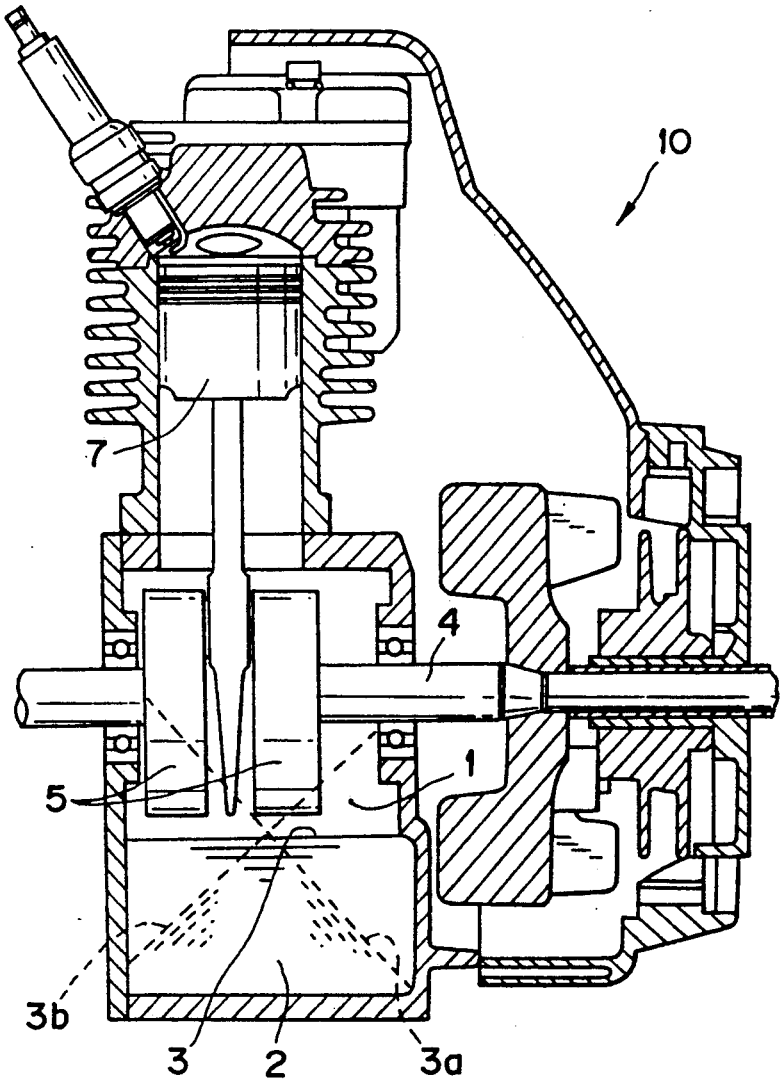
FIG. 4 PRIOR ART
FIG. 4 is an elevational section of a four-stroke cycle engine unit for a conventional structure of a portable working machine.
Figure 5:
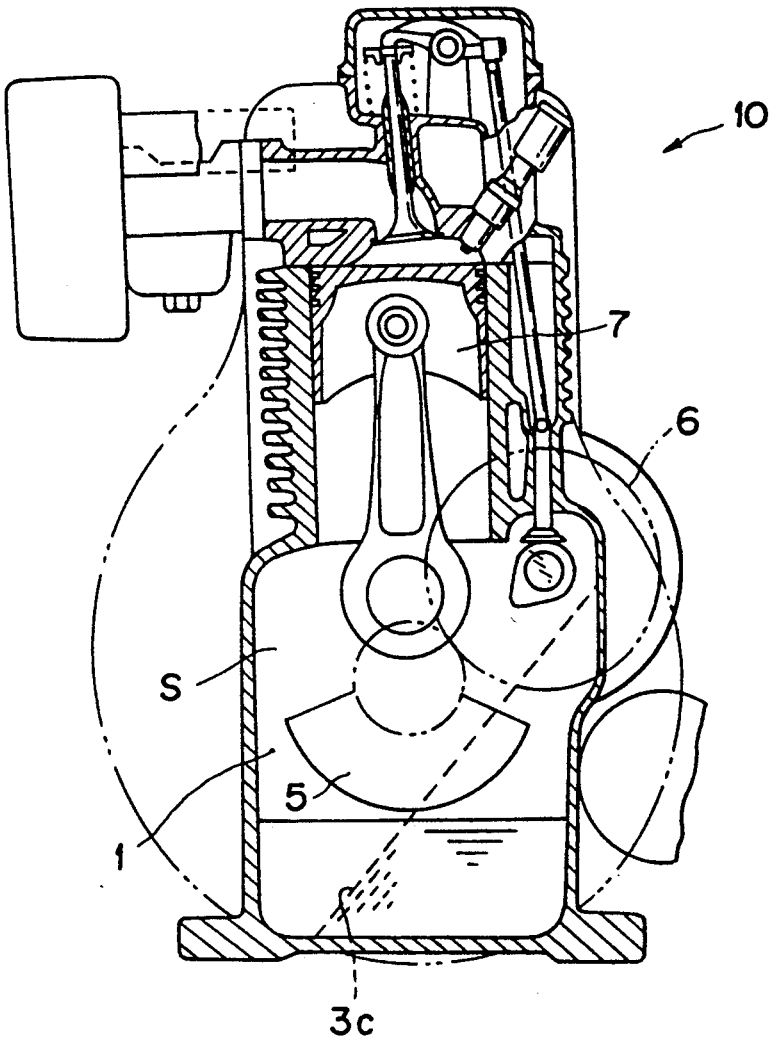
FIG. 5 PRIOR ART
FIG. 5 is a side sectional view of FIG. 4.

For a better understanding of this invention a prior art will be first described hereunder with reference to FIGS. 4 and 5 showing a conventional four-stroke cycle engine unit applied to a portable working machine.

Referring to FIGS. 4 and 5, when the four-stroke cycle engine unit is operated in the inclined state, an oil surface 3 of a lubrication oil 2 stored in a crank chamber 1 is also inclined as shown by broken lines as oil levels 3*a*, 3*b*, and 3*c*, so that the oil 2 is agitated by a cam gear 6 and counter-weights 5 mounted on a crank shaft 4, causing adverse generation of heat, resistance and oil-up phenomenon. As shown in FIG. 5, the crank chamber 1 of a four-stroke cycle engine 10 includes an inner gas space S, which has a volume larger than a volume of an inner gas space of a crank chamber of a two-stroke cycle engine. For the reason described above, pulsation pressure sufficient for driving a fuel pump for a carburetor cannot be obtained by the reciprocal motion of a piston 7 of a piston-cylinder assembly of the conventional four-stroke cycle engine 10.

This invention conceived for solving the above described problems of the conventional four-stroke cycle engine unit will be described hereunder with reference to FIGS. 1 to 3.

Figure 1:
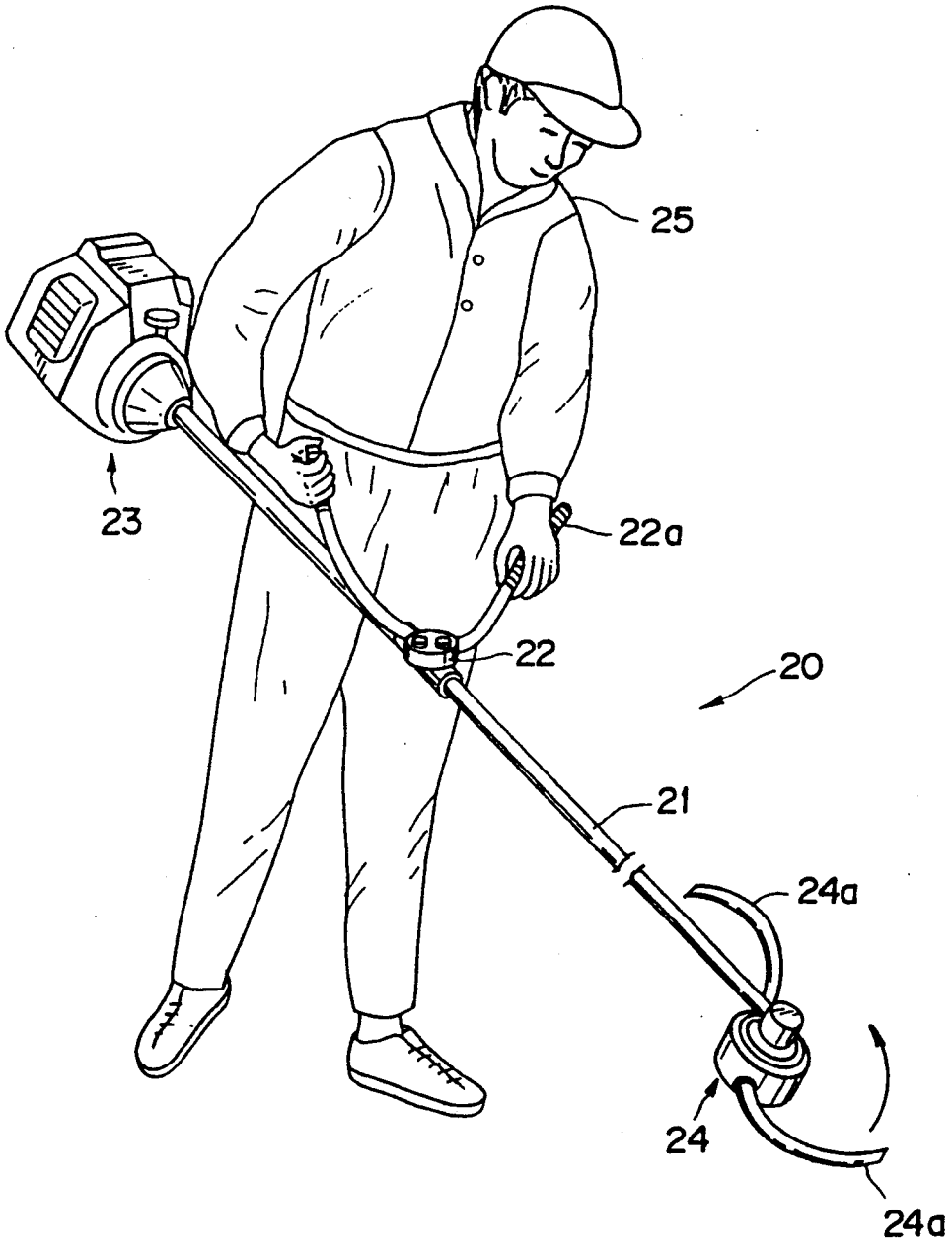

FIG. 1 is an illustration of a lawn mower 20 as one typical example of a portable working machine which is equipped with a four-stroke cycle engine unit.

Referring to FIG. 1, the lawn mower 20 generally comprises a long shaft-like power transmission member 20 generally operating portion 22 on which a handle member 22*a* is provided, a four-stroke cycle engine unit 23 secured to one end of the transmission shaft member 21 and a working device 24 secured to the other end thereof. The power generated by the driving of the engine unit 23 is transmitted to the working device 24 including a working member such as a lawn mower blade 24*a* through the power transmission shaft 21. The shaft member 21 is composed of an outer pipe member and an inner steel wire or rod which is connected to a crank shaft, i.e. output shaft, of the engine unit 23 through a clutch means. The steel rod is rotatably supported in the outer pipe member and transmits the power to the working device 24 and, hence, the lawn mower blade 24*a*.

When the lawn mower 20 is actually used, the lawn mower 20 is supported by an operator 25 who generally stands on the right side of the engine unit 23 as viewed in FIG. 1 and holds or grips the handle member 22*a*.

Figure 2:
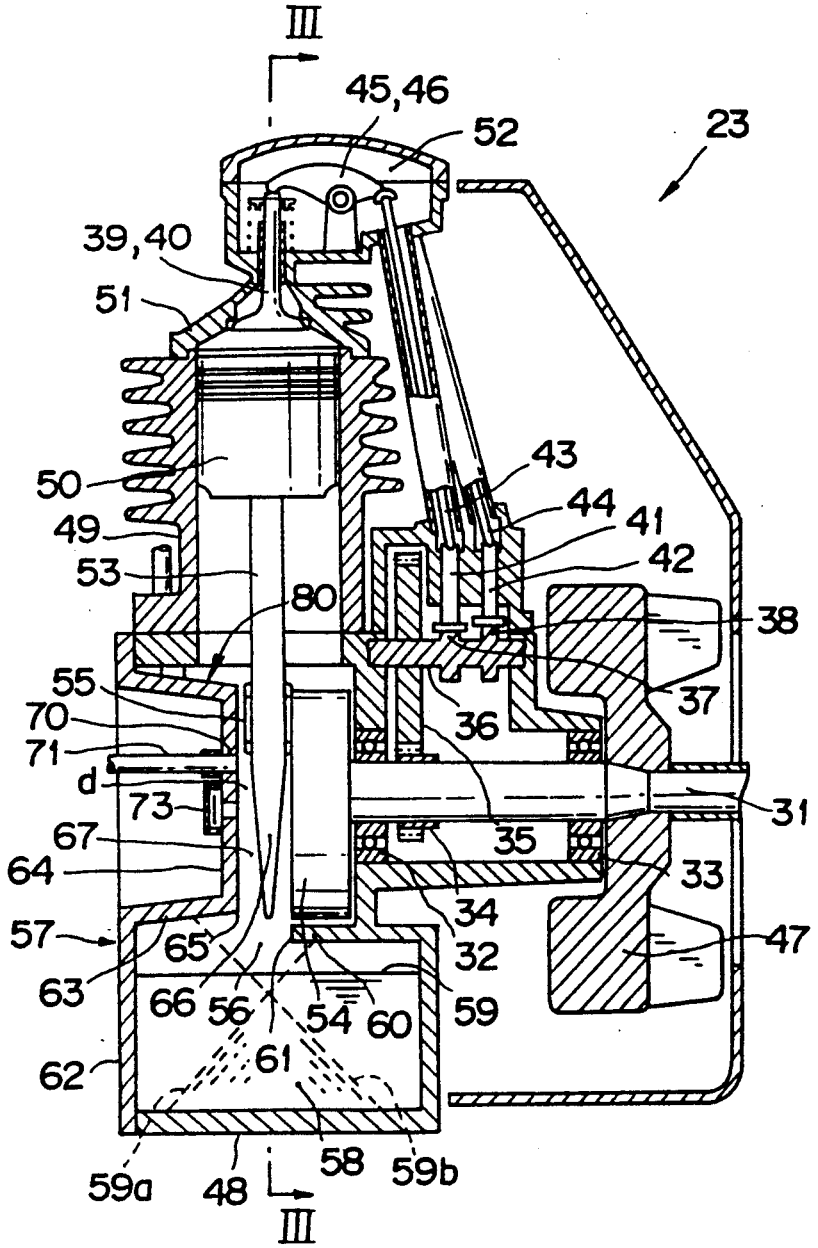
Figure 3:
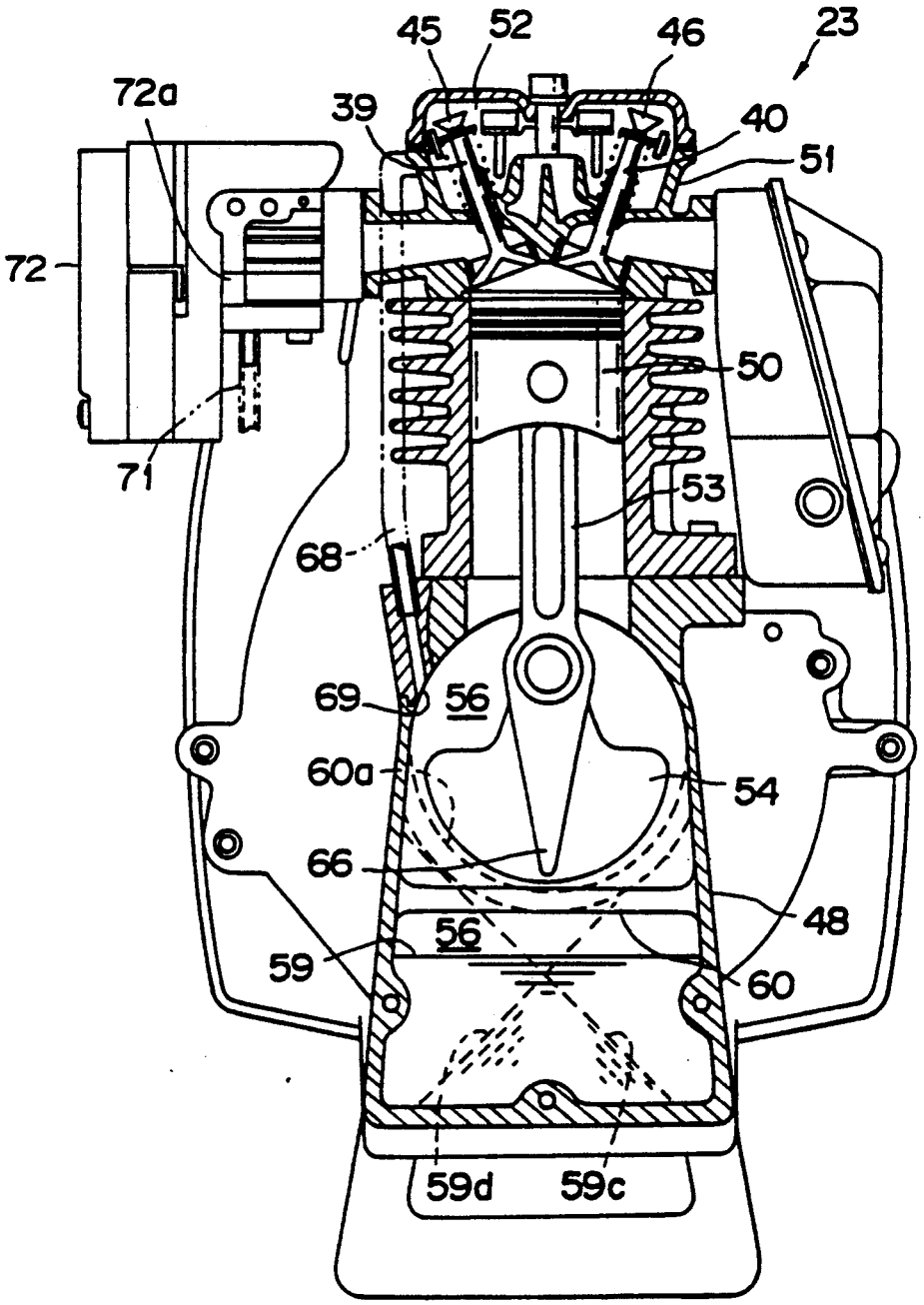

In the four-stroke cycle engine unit 23 according to this invention, as shown in FIGS. 2 and 3, an engine unit 23 includes a crank shaft 31, which is rotatably supported by bearings 32 and 33, on which a crank gear 34 is mounted. When the crank gear 34 is rotated, a cam gear 35 mounted on a cam shaft 36 and meshed with the crank gear 34 is also rotated in a direction reverse to the rotation of the crank gear 34. Onto the cam shaft 36 are formed an air inlet cam 37 and an exhaust cam 38. An air intake valve 39 and an air exhaust valve 40 are operated in accordance with the rotations of these cams 37 and 38 through tappets 41, 42, push rods 43, 44 and rocker arms 45, 46, respectively, in this order. A fly wheel 47 is mounted on one end of the crank shaft 31 to transmit a power to a power transmission shaft 21 through a clutch means.

The crank shaft 31 is rotatably supported by a crank chamber body 48 through the bearings 32 and 33 in a cantilevered manner. A piston-cylinder assembly composed of a cylinder 49 and a piston 50 is incorporated in the upper portion of the crank chamber body 48 and the piston 50 reciprocates in the cylinder 49 in a direction vertical as viewed. On the upper end portion of the cylinder 49 is mounted a cylinder head 51 supporting the air intake valve 39 and the air exhaust valve 40, and the cylinder head 51 includes an upper space as a valve chamber 52 in which the rocker arms 45 and 46 are accommodated.

The piston 50 is coupled with a connection rod 53 at its one end and the other end of the connection rod 53 is coupled with a counter-weight 54, through a crank pin 25, mounted on one end of the crank shaft 31. A crank chamber 56 is defined by the crank chamber body 48 and a cover member 57 for covering the crank chamber body 48. A lubrication oil 58 is sealed in the crank chamber 56. The lubrication oil 58 has an oil level 59 as shown by a solid line during the operation of the engine unit in not-inclined state such as horizontal state, whereas, during the operation of the engine unit in the inclined state, the oil level of the lubrication oil 58 is also inclined such as shown by a broken line showing oil level 59*a* or 59*b* in a maximumly inclined state.

A rib 60 is integrally provided for the crank chamber body 48 in a manner such that the rib 60 projects into the crank chamber 56 near the counter-weight 54 above the oil level 59 of the lubrication oil 58 at a time when the engine unit is used in the not-inclined state. In FIG. 3, the rib 60 is disposed horizontally linearly. On the contrary, in a case where the engine unit is used in the inclined state and the oil level is hence inclined as shown by broken line 59*c* or 59*d*, the rib 60 may be constructed so as to have an arcuate shape along the rotation locus of the outer peripheral surface of the counter-weight 54, which is shown by a broken line as a rib 60*a*. The rib 60 projects towards the cover member 57 by the length suitable for preventing the lubrication oil from flowing over the end edge portion 61 of the rib 60 when the engine unit 23 is inclined and the oil 58 takes its inclined surface level 59*a*.

The cover member 57 is disposed so as to entirely cover the lefthand, as viewed opening of the crank chamber body 48 and detachably fastened thereto in a sealed manner by means of bolts or the like.

The cover member 57 is composed of a main body 62 detachably secured to the crank chamber body 48, a side wall portion 63, having a rotational surface, which is integrally formed with the main body 62 and which has an inverted or fallen trapezoidal shape in section as shown in FIG. 2 and a circular wall portion 64 integrally formed with the side wall 63. Namely, the side wall 63 and the circular wall 64 are formed as a projecting portion 80 projecting into the crank chamber 56 from the main body 62 so as to reduce the inner space of the crank chamber 56, that is, in FIG. 2, the projecting portion 80 projects rightwardly inside the crank chamber 56. The projecting portion 80 faces the side surface of the counter-weight 54 mounted on the crank shaft 31, and in a preferred embodiment, the projecting portion 80 is disposed substantially concentrically with the rotation axis of the crank shaft 31. In a preferred embodiment, it is also desired to locate the wall portion 64 as near as possible near the moving surfaces of the connection rod 63 and the crank pin 55 and to locate the right-hand end, as viewed in FIG. 2, of the side wall portion 63 as near as possible near the end edge portion 61 of the rib 60. Furthermore, the side wall portion 63 has a projecting length towards the counter-weight 54 such that the oil 58 does not flow over the end edge portion 65 of the side wall portion 63 even in a case where the oil 58 is inclined in a state having the oil level **59*b*** at the time of the engine inclination operation.

According to this structure, since the rib 60 and the side wall portion 63 of the cover member 57 are deeply projected into the crank chamber 56, the lubrication oil 58 does not much contact the rotating portion of the crank shaft 31 even if the engine unit 23 is driven in an inclined state. Otherwise, even if the oil 58 contacts the rotating portion of the crank shaft 31, since there remains less space between the counter-weigh 54 and the rib 60, the oil will be preferably splashed. As can be understood from comparison of the embodiment shown in FIG. 2 with the conventional example of FIG. 4, according to this embodiment, only one counter-weight 54 is disposed, the lubrication oil 58 is not excessively agitated by the rotating member including the counter-weight 54, thus not increasing much the resistance and not increasing the temperature of the oil 58. The lubrication to the piston 50 can be also fully made by the splash of the oil through a gap between the rotational side wall surface portion 63 and the rib 60, thus causing no problem for the lubrication of the piston 50.

Therefore, the four-stroke cycle engine unit 23 having a compact structure and attaining sufficient functions as described above can be effectively mounted on a portable working machine such as the lawn mower 20 of FIG. 1.

Further, the side wall portion 63 having a rotational surface shape of the cover member 57 has an effect for reducing the inner space volume of the crank chamber body 48 because of its rotational surface shape. Moreover, since only one counter-weight 54 is disposed, the inner space volume of the crank chamber can be also reduced. In this regard, it is of course necessary for the inner space volume to store a suitable amount of the lubrication oil 58, but such reduction of the space volume cannot substantially reduce the effective space volume for storing the lubrication oil 58 in so far as the volume is extremely much reduced. Accordingly, in spite of the fact that the four-stroke cycle engine unit is mounted, the pulsation gas pressure far larger than that obtained by the conventional four-stroke cycle engine unit such as shown in FIG. 4, for example, can be caused according to the present four-stroke cycle engine unit 23, whereby the membrane valve type carburetor can be effectively operated.

The lubrication of the cylinder 49 and the piston 50 of the piston-cylinder assembly is performed by scraping the lubrication oil 58 by a scraping rod 66 connected integrally with the connection rod 53 in accordance with the reciprocal motion of the piston 50. During this lubricating operation, the lubrication oil 58 rises, while being splashed, in a passage 67 defined by the cover member 57 and the crank chamber body 48 by a centrifugal force caused by the rotational surface shape of the side wall portion 63. As shown in FIG. 3, the crank chamber 56 and the valve chamber 52 are communicated through a communication pipe 68 formed to the crank chamber body 48 as a cylinder head lubrication passage and the communication pipe 68 is provided with an end opening 69 opened at a slightly upper portion of the crank chamber 56, so that it is easily made to lubricate the rocker arms 45 and 46 and the intake and exhaust valves 39 and 40 disposed in the valve chamber 52.

Furthermore, the lubrication oil 58 is hardly invaded or splashed into a space d (for example, near a central portion of the circular wall portion 64) between the moving surface of the connection rod 53 and the wall portion 64 of the cover member 57 because of the centrifugal force of the connection rod 53. The communication pipe 68 communicating the crank chamber 56 and the cylinder head 51 may be integrally formed with the cylinder head 51.

Accordingly, by providing a pulsation pressure take-out port 70 in the space d, that is, to the circular wall portion 64 and connecting this pulsation pressure take-out port 70 to a pump means **72*a* of a carburetor 72 through a pulsation pressure communication pipe 71, the lubrication oil 58 is never splashed into the pipe 71, thus not causing inconvenience to operation. Furthermore, by also providing a breather 73 for the inner pressure of the crank chamber 56 in the space d, the lubrication oil 58 is also not splashed or invaded into the breather 73, thus also not causing inconvenience to operation. It will be of course understood that it is not necessary to locate at the same time or position the breather 73 and the take-out port 70 of the pulsation pressure communication pipe 71 and they may be located independently at another portion of the engine unit 23**.

Referring to FIGS. 2 and 3, as described hereinbefore, a force caused by the piston 50 is transmitted to the crank shaft 31 through the connection rod 53, the crank pin 55 and the counter-weight 54. When the engine unit 23 is viewed from the power take-out side, the crank shaft 31 rotatably supported by the bearings 32 and 33 is rotated in the clockwise direction, and accordingly, the gear 35 meshed with the crank gear 34 secured to the crank shaft 31 is hence rotated in the counterclockwise direction, whereby an air intake cam 37 and the air exhaust cam 38 both connected to the rotation shaft 36 of the cam gear 35 operate the tappets 41 and 42 and push rods 43 and 44, thereby operating the intake and exhaust valves 39 and 40 through the operations of the rocker arms 45 and 46, respectively.

According to the four-stroke cycle engine unit provided with the crank chamber of the improved structure according to this invention, the inner volume of the crank chamber 56 can be made small, thereby causing a pulsation gas pressure larger than that of the conventional crank chamber structure, whereby the carburetor, i.e. membrane valve type carburetor can be operated even in its inclined state.

Since the rib 60 is provided at a portion near the counter-weight 54 in the crank chamber 56 and the cover member 57 projects into the crank chamber 56, the lubrication oil 58 in the crank chamber 56 is not excessively agitated even if the engine unit 23 is driven in the inclined state, thus preventing adverse heat generation, resistance and oil-up phenomenon, and the lubrication oil 58 is not also excessively lubricated to the piston 50.

Furthermore, since the lubrication oil 59 raises, by the centrifugal force, in the passage 67 formed by the circular wall portion 64 and the crank chamber body 48, the cylinder head 51 can be also lubricated by providing the communication port 69 to the passage 67 for feeding the lubrication oil 58 into the cylinder head 51.

Still furthermore, since the lubrication oil 58 in the crank chamber 56 is raised by the centrifugal force, the oil is less splashed at a portion near the wall portion 64 of the cover member 57, and accordingly, the splashing of the lubrication oil can be prevented by locating the breather 73 and the pulsation pressure take-out port 70 in the space d.

Consequently, according to this invention, four-stroke cycle engine unit which can be effectively used even in the inclined state can be realized for a portable working machine.

It is to be noted that this invention is not limited to the described preferred embodiment and many other changes and modifications may be made without departing from the scope of the appended claims.

What is claimed is:

1. A crank chamber structure of a four-stroke cycle engine unit comprising:

a crank chamber body defining a crank chamber in which a lubrication oil is sealed and in which a crank shaft mounting a counter weight member thereon is rotatably supported;

a rib member provided for the crank chamber body projecting in the crank chamber near the counter-weight member; and a cover member for covering the crank chamber body, said cover member being provided with a projecting portion substantially facing a side surface of the counter-weight member and projecting deeply inside the crank chamber;

said rib member extending horizontally linearly and having an extension towards the cover member so as to prevent the lubrication oil in the crank chamber from flowing over an end edge portion of the rib member when the engine unit is operated in an inclined state with respect to a horizontal plane.

2. A crank chamber structure according to claim 1, wherein said crank chamber body is provided with an opening of a communication pipe communicating the crank chamber with a valve chamber of a cylinder head of the engine unit, said opening being positioned above the crank chamber.

3. A crank chamber structure according to claim 1, wherein said counter-weight member comprises a single counter-weight mounted on the crank shaft.

4. A portable working machine equipped with an engine unit including a crank chamber structure according to claim 1, comprising:

a working device driven by the four-stroke cycle engine unit;

a power transmission shaft member having one end connected to the working device for transmitting an output power of the four-stroke cycle engine unit to the working device; and a handle means mounted onto the power transmission shaft member and operated by an operator.

5. A crank chamber structure of a four-stroke cycle engine unit comprising:

a crank chamber body defining a crank chamber in which a lubrication oil is sealed and in which a crank shaft mounting a counter weight member thereon is rotatably supported;

a rib member provided for the crank chamber body projecting in the crank chamber near the counter-weight member; and a cover member for covering the crank chamber body, said cover member being provided with a projecting portion substantially facing a side surface of the counter-weight member and projecting deeply inside the crank chamber; and said cover member comprising a main cover body secured to the crank chamber body, a side wall portion having a rotation surface of substantially a fallen trapezoidal shape in section, and a circular wall portion formed integrally with the side wall portion, said side wall portion and said circular wall portion constituting the projecting portion projecting inside the crank chamber as an integrated structure.

6. A crank chamber structure according to claim 5, wherein said projecting portion is disposed substantially concentrically with a rotation axis of the crank shaft.

7. A crank chamber structure according to claim 5, wherein said circular wall portion is positioned proximate a moving surfaces of a crank pin and a connection rod connected to the counter-weight member through the crank pin.

8. A crank chamber structure according to claim 5, wherein said side wall portion extends towards the counter-weight into the crank chamber by an amount for preventing the lubrication oil from flowing over an end edge portion of the side wall when the engine unit is operated in an inclined state with respect to a horizontal plane.

9. A crank chamber structure according to claim 5, wherein a pulsation gas pressure take-out port is provided to the circular wall portion so as to be positioned in a narrow space between the side wall portion and the moving surface of the connection rod, said pulsation gas pressure take-out port being communicated with a pump means for a carburetor of the engine unit through a communication pipe.

10. A crank chamber structure according to claim 9, wherein the carburetor is a membrane valve type carburetor.

11. A crank chamber structure according to claim 5, wherein a breather is provided to the circular wall portion so as to be positioned in a narrow space between the side wall portion and the moving surface of the connection rod, said breather acting to release an excess gas pressure into atmosphere through the breather.

12. A four-stroke cycle engine unit comprising:

a crank chamber body defining a crank chamber in which a lubrication oil is sealed;

a crank shaft cantilevered to the crank chamber body so as to extend inside the crank chamber and rotatably supported therein;

a piston-cylinder assembly composed of a cylinder and a piston to be reciprocal in the cylinder;

a cylinder head disposed above the piston-cylinder assembly in which air intake and exhaust valves are accommodated;

a counter-weight member mounted on the crank shaft;

a connection rod having one end connected to the piston and another end connected to the counter-weight member through a crank pin;

a carburetor operatively connected to the cylinder head;

a rib member provided for the crank chamber body projecting in the crank chamber near the counter-weight member; and a cover member for covering the crank chamber body, said cover member being provided with a projecting portion substantially facing a side surface of the counter-weight member and projecting deeply inside the crank chamber;

said rib member extending horizontally linearly and having an extension towards the cover member so as to prevent the lubrication oil in the crank chamber from flowing over an end edge portion of the rib member when the engine unit is operated in an inclined state with respect to a horizontal plane.

13. A crank chamber structure of a four-stroke cycle engine unit comprising:

a crank chamber body defining a crank chamber in which a lubrication oil is sealed and in which a crank shaft mounting a counter weight member thereon is rotatably supported;

a rib member provided for the crank chamber body projecting in the crank chamber near the counter-weight member; and a cover member for covering the crank chamber body, said cover member being provided with a projecting portion substantially facing a side surface of the counter-weight member and projecting deeply inside the crank chamber; and said rib member having an arcuate shape substantially along a rotation locus of an outer peripheral surface of the counter-weight member, said rib member having an extension towards the cover member so as to prevent the lubrication oil in the crank chamber from flowing over an end edge portion of the rib member when the engine unit is operated in an inclined state with respect to a horizontal plane.

* * * * *